United States Patent [19]

Dietz

[11] 4,058,132

[45] Nov. 15, 1977

[54] NAIL POLISH BOTTLE OPENER

[75] Inventor: Frederick P. Dietz, Rte. 2, Box 201, Monee, Ill. 60449

[73] Assignees: Charles Jacobus; Josephine Jacobus, both of Chicago; Leroy Wiltgen; Rita Wiltgen, both of Franklin Park, all of Ill. ; part interest to each

[21] Appl. No.: 584,509

[22] Filed: June 6, 1975

[51] Int. Cl.[2] ..... A45D 29/00

[52] U.S. Cl. ..... 132/73

[58] Field of Search ..... 132/73, 75.3, 75.6, 132/76.5; 30/27; 7/1 C, 1 G, 17, 14.6; 81/90 B, 3.34, 3.4; D8/34

[56] References Cited

U.S. PATENT DOCUMENTS

| | | | |
|---|---|---|---|
| 1,034,794 | 8/1912 | Hayes | 7/1 C |
| 2,544,479 | 3/1951 | Zengel | 30/27 |
| 3,354,757 | 11/1967 | Grimm et al. | 81/90 B |
| D. 167,899 | 10/1952 | Joannides | D8/34 |

*Primary Examiner*—G.E. McNeill

*Attorney, Agent, or Firm*—Thomas R. Vigil

[57] ABSTRACT

The nail polish bottle opener is generally flat and elongate having a wide end portion at one end, and narrow end portion at the opposite end and a midportion connecting the end portions. The wide end portion has a opening therein which has a serrated periphery and which is sized to fit over and between the top and bottom of a conically shaped bottle cap for a bottle of nail polish. The midportion and narrow end portion form a handle for gripping the opener. Also, one side of the opener in the midportion and narrow end portion has a nail file surface thereon.

1 Claim, 2 Drawing Figures

NAIL POLISH BOTTLE OPENER

BACKGROUND AND SUMMARY OF THE INVENTION

The present invention relates to a tool for use in caring for fingernails and particularly to a tool for opening a bottle of nail polish. The tool also can have a nail file surface thereon so that the tool can serve as a nail file.

Fingernail polish is a very popular cosmetic and typically has a laquer base to enable it to be applied easily to the nail and to provide a quick drying and strongly adhesive covering for the nail. Often, during use of a bottle of polish, polish finds it's way between the screw thread neck of the bottle in which it is stored and the bottle cap received thereon, and drys causing the bottle cap to become adhered or frozen to the bottle. Much force is then required to turn the cap to open the bottle. Typically a pliers is then needed to open the bottle.

In view of this problem the bottle cap is typically formed with a conical, serrated, often elongate, outer surface which facilitates gripping of the bottle cap for exerting sufficient torque to open the bottle.

Notwithstanding this special configuration of the bottle cap, users of nail polish still encounter much difficulty in opening a bottle of nail polish. Accordingly, a principal object of the present invention is to provide a nail polish bottle opener which facilitates opening of a bottle of nail polish.

As will be described in more detail hereinafter, the tool of the present invention is simple in design, is planar and elongate and has an opening therein which is sized to fit over and between the top and bottom of a bottle cap for a bottle of nail polish and which is configured to grippingly engage the bottle cap. Although it does not appear that such a tool has heretofore been proposed for opening a bottle of nail polish, tools having a similar shape have been proposed for turning a specially configured nut or bolt head having splines thereon. In this regard reference is made to the wrenching member disclosed in U.S. Pat. No. 3,354,757.

The tool of the present invention differs from the wrenching member in several respects, namely in the shape and configuration of the opening of the tool and of course in the purpose and use of the tool. Other differences are brought out in the detailed description of the preferred embodiment of the tool set forth below.

According to the invention there is provided a nail polish bottle opener comprising a generally flat, elongate member having a wide end portion at one end, a narrow end portion at the opposite end and a midpoint connecting said end portions, said wide end portion having an opening therein sized to fit over and between the top and bottom of a conically shaped bottle cap for a bottle of nail polish, the periphery of said opening being configured to grippingly engage the bottle cap whereby a user, after inserting a bottle cap in said opening, can grip said tool about said midportion and said narrow end portion and exert a torque about the coaxial axes of said opening and the bottle cap to open the bottle of nail polish.

Preferably one side surface of the opener has a nail file surface in the midportion and narrow end portion thereof so that the tool also functions as a nail file.

DESCRIPTION OF THE PREFERRED EMBODIMENT OF THE INVENTION

Figure 1:
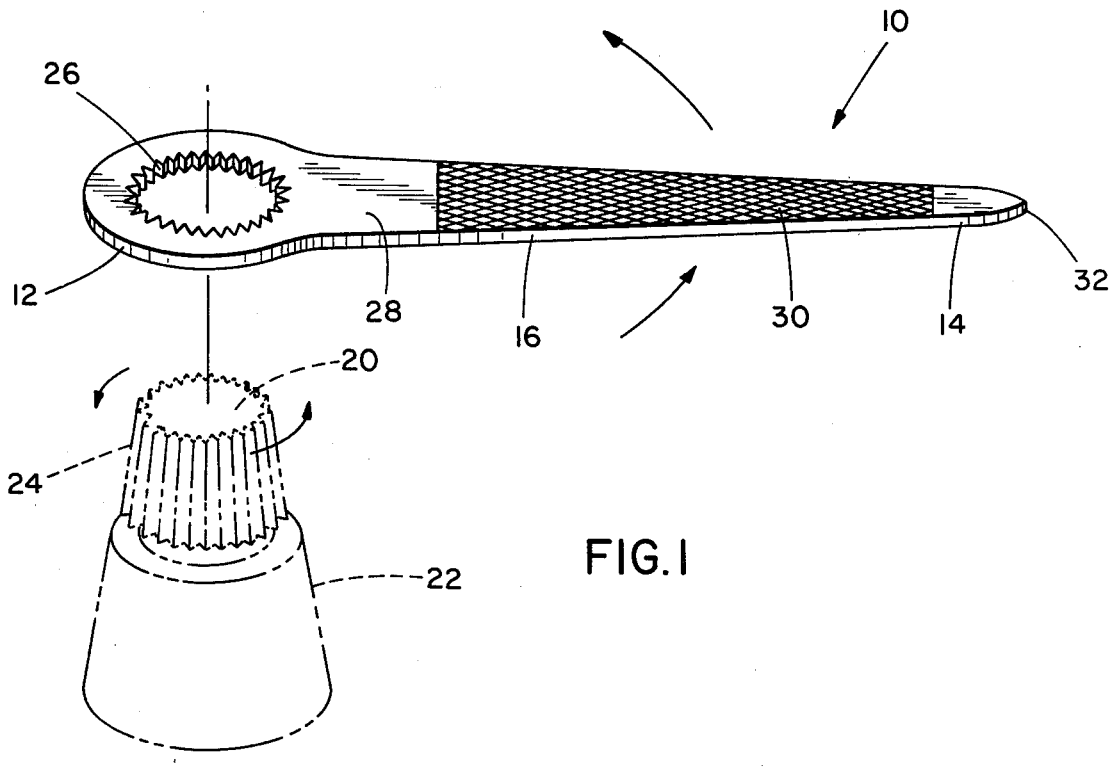
FIG. 1 is an elevational perspective view of the tool of the invention.
Figure 2:
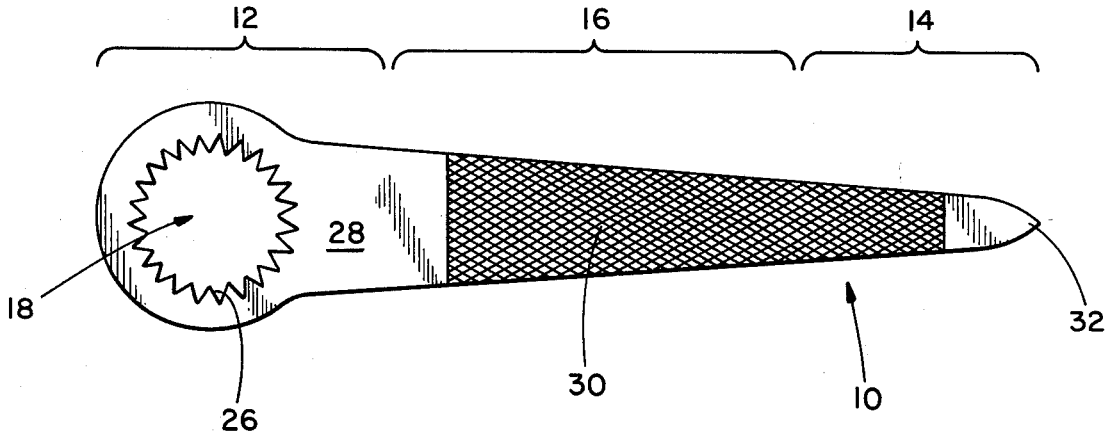
FIG. 2 is a top plan view of the tool shown in FIG. 1.

Referring now to the drawings in greater detail, the opener or tool of the invention is generally identified by the reference numeral 10.

As shown the tool 10 is generally planar having an elongate shape with a wide, generally circular, end portion 12 at one end, a narrow end portion 14 at the opposite end and a midportion 16 connecting the end portions 12 and 14. The midportion 16 tapers from the end portion 12 to the end portion 14.

The end portion 12 has a generally circular opening 18 therein which is sized to fit over and between the top and bottom of a bottle cap 20 for a bottle of nail polish 22. The bottle cap 20 is conical in shape and has serrations 24 on the outer surface thereof and the periphery of the opening 18 is serrated — formed with serrations 26 thereon — for grippingly engaging the bottle cap 20.

With the tool 10 having a generally planar shape with opposite generally flat sides, such as the side 28, the tool 10 can have a nail file surface formed thereon as shown in the drawings and identified by the reference numeral 30. The nail file surface 30 is located on the side 28 in the midportion 16 and narrow end portion 14 of the tool 10. Also the narrow end portion tapers to a point 32 which can be used for cleaning the underside of a fingernail.

The tool 10 is multifunctional and simple in design. On the one hand it functions as a bottle opener. For this use, a frozen bottle cap 20 is inserted into the opening 18 and then, gripping the bottle 22 in one hand and the tool 10 in the other hand (i.e., gripping the midportion 16 and narrow end portion 14 which serve as a lever arm), a user exerts a torque about the coaxial axes of the bottle cap 20 and the opening 18 to open the bottle.

On the other hand, before applying the polish the tool 10, i.e., the file surface 30, can be used as a nail file for manicuring the nails.

The tool of the present invention has a number of advantages some of which have been set forth above and others of which are inherent in the invention. For example, in addition to the advantages stated above it is inexpensive to manufacture and the estimated retail price thereof is only slightly higher than the price of a conventional nail file. Also it is to be understood that obvious modifications can be made to the invention, such as altering the shape of the tool 10 or of the gripping means on the periphery of the opening 18, without departing from the spirit or scope of the invention. Accordingly, the scope of the invention is only to be limited as necessitated by the accompanying claims.

I claim:

1. A tool utilized in finger nail care, said tool being substantially planar with opposite substantially flat sides and having a generally, elongate teardrop shape with a wide end portion at one end, a narrow end portion at the opposite end and a mid-portion connecting said end portions, said wide end portion having a generally circular opening therein sized to fit over and between the top and bottom of a conically shaped cap having serrations thereon for a bottle of nail polish, the inwardly facing periphery of said opening having serrations formed thereon which are configured to mate with the serrations on the cap and to grippingly engage the bottle cap whereby said tool can be used as a nail polish bottle opener by first placing the opening over a conically shaped serrated bottle cap, followed by gripping said narrow end portion of said tool and then exerting a torque about the coaxial axes of said opening and the bottle cap, and one side of said tool having a nail file surface formed thereon in the mid-portion and narrow end portion of said tool whereby said tool also can be used as a nail file.

* * * * *